United States Patent [19]

Hasegawa

[11] 4,228,381

[45] Oct. 14, 1980

[54] FLASH TUBE APPARATUS WITH DELAYED EMISSION

[75] Inventor: Hiroshi Hasegawa, Tokyo, Japan

[73] Assignee: Nippon Kogaku K.K., Tokyo, Japan

[21] Appl. No.: 949,266

[22] Filed: Oct. 6, 1978

[30] Foreign Application Priority Data

Oct. 6, 1977 [JP] Japan ..... 52-119422

[51] Int. Cl.[2] ..... H05B 41/32

[52] U.S. Cl. ..... 315/151; 315/241 P; 354/33

[58] Field of Search ..... 315/151, 159, 241 P; 354/33, 137, 145

[56] References Cited

U.S. PATENT DOCUMENTS 3,987,468 10/1976 Matsuzaki et al. ..... 354/145

FOREIGN PATENT DOCUMENTS 2452108 5/1976 Fed. Rep. of Germany ..... 315/241 P
2753208 6/1978 Fed. Rep. of Germany ..... 354/33
1396685 6/1975 United Kingdom ..... 315/241 P

*Primary Examiner*—Eugene R. LaRoche
*Attorney, Agent, or Firm*—Shapiro and Shapiro

[57] ABSTRACT

A flash tube (speed-light) apparatus is provided with a drive circuit for ionizing gas in the flash tube in response to a triggering voltage produced by a trigger coil, and a light-measuring circuit measures the light emitted by the flash tube and reflected by an object to be photographed and controls the quantity of light emitted by the flash tube. The drive circuit comprises delay means that delays the flash emission by a predetermined delay time commencing with the energizing of the trigger coil. The delay time is selected longer than a period during which the light-measuring circuit is affected by noise generated by the energizing of the trigger coil.

6 Claims, 2 Drawing Figures

FLASH TUBE APPARATUS WITH DELAYED EMISSION

BACKGROUND OF THE INVENTION

1. Field of the Invention

The present invention relates to flash tube or speed-light apparatus, and more particularly to a flash tube drive circuit in a speed-light apparatus.

2. Description of the Prior Art

In flash photography with a single-lens reflex camera having a through-the-lens light measurement system equipped with a speed-light apparatus, it has been proposed to control the quantity of light emitted by the speed-light apparatus by measuring the light emitted by the speed-light apparatus and reflected by the object to be photographed.

In such conventional apparatus, however, a high voltage used for triggering the flash tube often generates noise affecting the light-measuring circuit, and the circuit assumes a "latched" or abnormal state and is unable to provide a correct light measurement output. For this reason the conventional speed-light apparatus is deficient in its ability to properly control the quantity of light emitted and thus to provide an appropriate exposure.

A conventional light measuring circuit comprising an operational amplifier, a light-sensitive element connected between the inverting input and non-inverting input terminals thereof, and a logarithmic diode connected between input and output terminals of the operational amplifier, may be provided with a bypass diode parallel to the logarithmic diode to expedite recovery from the abnormal state caused by the triggering noise. However, such a light measuring circuit is not free of the undesirable latching effect, although recovery from the abnormal state caused by the noise is expedited.

SUMMARY OF THE INVENTION

An object of the present invention, therefore, is to provide a flash tube or speed-light apparatus in which a light measuring circuit is not affected by the noise generated upon energizing of a trigger coil for triggering the flash tube.

In a speed-light apparatus comprising a drive circuit having a trigger coil for triggering a flash tube by ionizing a gas contained therein and comprising a light measuring circuit for measuring the reflected light emitted by the flash tube and controlling the quantity of emitted light in response to the measurement, the foregoing object is achieved, in accordance with the invention, by providing in the drive circuit a delay circuit which delays light emission from the flash tube until the lapse of a predetermined time from the energizing of the trigger coil.

DESCRIPTION OF PREFERRED EMBODIMENT

Now the present invention will be explained in detail with reference to the embodiment thereof shown in the accompanying drawings.

Figure 1:
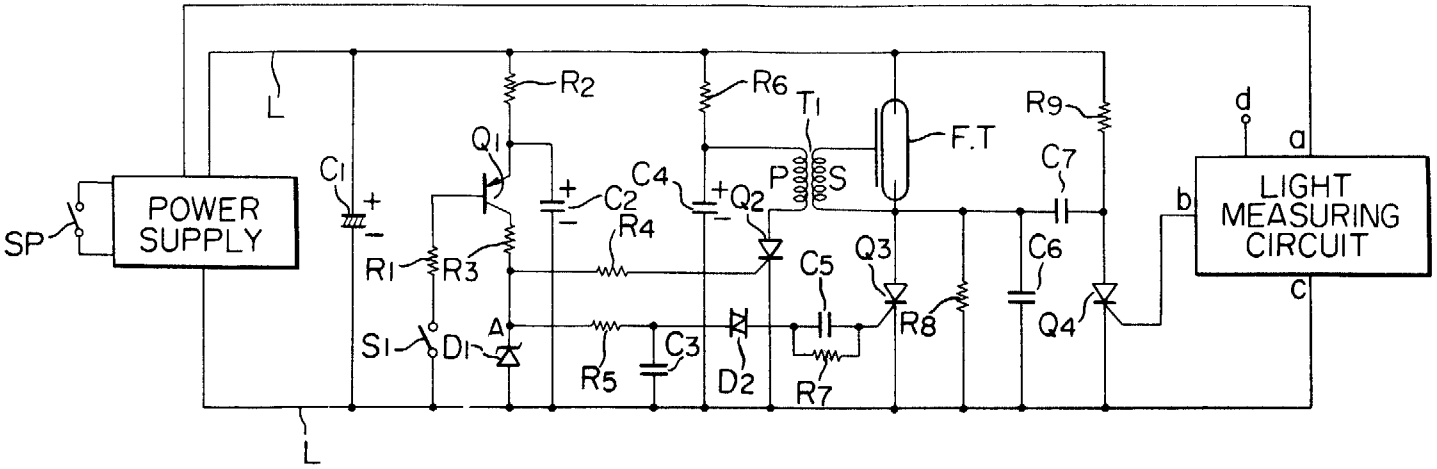
FIG. 1 is a combined block and detailed circuit diagram of a speed light apparatus embodying the present invention.

Referring to FIG. 1. upon closing of a power switch SP, electric power from a power supply (so-designated) is supplied to power supply lines L to charge a main capacitor C1 for accumulating the flash energy for a flash tube FT connected between the power supply lines L. Also a capacitor C2 is charged through a resistor R2, a trigger capacitor C4 through a resistor R6, and a diverting capacitor C7 through resistors R9 and R8.

Upon subsequent turning-on or closing of a trigger switch S1 synchronized with the synchronizing contact of a camera, a transistor Q1 becomes conductive to release the charge accumulated in the capacitor C2 through a serial circuit of the transistor Q1, a resistor R3 and a Zener diode D1, connected parallel to the capacitor C2, thereby generating a predetermined voltage at the point A. That voltage is supplied, through a resistor R4, to the gate of a silicon controlled rectifier (SCR) Q2 to render the SCR conductive, thereby discharging the capacitor C4 through the primary coil of a trigger coil T1. As the result, there is generated, at the secondary side of the trigger coil T1, a high voltage which is applied around the flash tube FT to ionize the Xenon gas, thereby reducing the internal resistance thereof. Thus the current supplied from the power supply partly flows through the flash tube FT and further through a resistor R8 and a capacitor C6, but the main discharge current, or the main flash, is not induced in the flash tube FT, as the SCR Q3 present in the main circuit thereof is not yet turned on because of the presence of a delay circuit of the present invention to be explained hereinafter.

Upon generation of a voltage at the point A by closing the trigger switch S1 in the above-explained manner, there is started the operation of a delay circuit comprising a resistor R5, a capacitor C3 and a diac D2. When the voltage of the capacitor C3 becomes in excess of the breakover voltage of the diac D2, diac D2 is turned on to render the SCR Q3 conductive through the capacitor C5 and resistor R7. As the flash tube FT still maintains the above-mentioned ionized state, the main discharge current is immediately induced upon the turning-on of SCR Q3, thereby initiating the main flash. In this manner the closing of trigger switch S1 causes the ionization of the flash tube FT by the high voltage generated by the trigger coil, but the main flash is not initiated immediately, only after a determined delay time.

Figure 2:
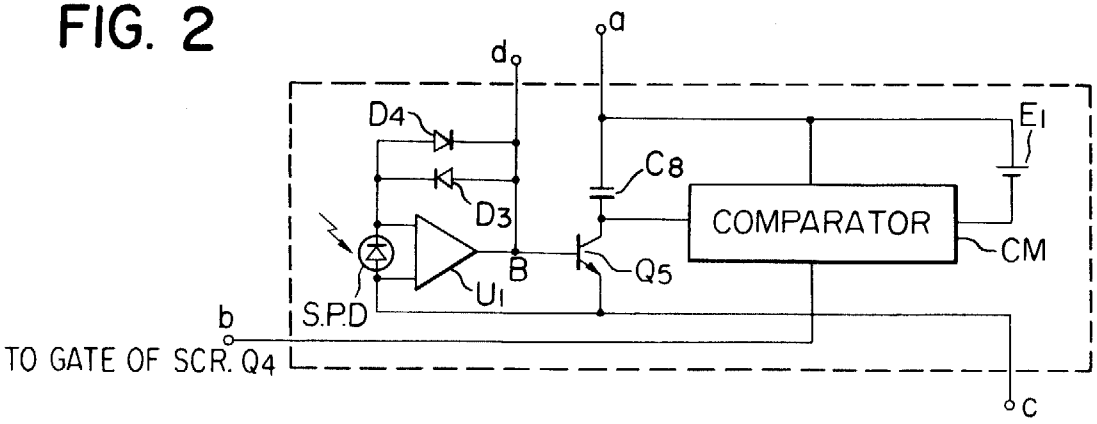
FIG. 2 is a detailed circuit diagram of a light-measuring circuit shown as a block in FIG. 1.

FIG. 2 shows the details of the light-measuring circuit shown in FIG. 1.

Upon receipt of the light emitted by the flash tube FT and reflected by an object to be photographed, a photosensitive device such as photodiode SPD and operational amplifier U1 generate at point B a voltage $$\frac{KT}{q} \ln \frac{I_D}{I_S}$$

proportional to the logarithm of the photocurrent, wherein K is Boltzman's constant, T absolute temperature, q the charge of an electron, $I_D$ photocurrent and $I_S$ saturated current in inverse direction in diode D3. This voltage is supplied through terminal d to a camera control system (not shown) for controlling the shutter, diaphragm, etc. in a well known manner. The voltage is also applied to a transistor Q5 across the base and emitter thereof, whereby there exists a relation:

$$V_{BE} = \frac{KT}{q} \ln \frac{I_C}{I_S}$$

wherein $V_{BE}$ is the voltage between the base and emitter, and $I_C$ is the collector current. Comparing this equation with the foregoing voltage at the point B, it will be understood that $I_C = I_D$, that is, the collector current of transistor Q5 is equal to the photocurrent $I_D$. This current is integrated by the capacitor C8, and a comparator CM produces a signal at terminal b to turn on an SCR Q4 when the voltage across the capacitor C8 reaches a predetermined voltage E1. Upon the turning on of the SCR Q4, the charged voltage of capacitor C7 is inversely applied to the SCR Q3, thereby turning off SCR Q3. The main circuit for the flash tube FT being thus disconnected, the flash discharge is terminated. In this manner, the flash energy (light intensity × flash duration) is controlled by the period required for a current proportional to the measured light to be integrated to produce a predetermined voltage.

As explained in the foregoing, the object of the present invention is to avoid erroneous operation of the light-measuring circuit at the start of light measurement. Such erroneous operation occurs in the following manner. Referring to FIG. 2, the high voltage generated by the trigger coil upon the energizing thereof is applied as a noise signal to the operational amplifier U1, and this signal, when applied as a positive voltage to the inverting input terminal of the operational amplifier, is accumulated as a charge in the junction capacity of the photosensitive element SPD.

In an effort to eliminate the effect of this charge, there is provided a bypass diode D4 parallel to the logarithmic diode D3. Diode D4 is rendered conductive when the potential at the point B reaches approximately zero upon receipt of the above-mentioned positive noise voltage at the inverting input terminal, so as to discharge the charge accumulated in the junction capacity of photosensitive element SPD, whereby the operational amplifier recovers the normal state thereof. However, it has been discovered that despite the addition of diode D4, the light-measuring circuit continues to be adversely affected by the noise and that the continued adverse effect is due to the fact that flash discharge and light measurement occur before the operational amplifier recovers its normal state. If the flash discharge is initiated after the light-measuring circuit recovers its normal state, the erroneous operation of the light-measuring circuit is avoided, but the period from the high voltage generation by the trigger coil to the initiation of main discharge in the conventional speed light is generally of the order of several tens of microseconds at longest, which is shorter than the recovery time of the operational amplifier. Under these circumstances, the light-measuring circuit does not recover its normal state before the discharge is initiated and is therefore unable to perform the exact light-measuring operation required for a proper exposure.

However, in the drive circuit of the speed light apparatus according to the present invention, the discharge in the flash tube is initiated after the lapse of a predetermined period commencing with the high voltage generation in the trigger coil T1 that causes the noise generation. Thus the light-measuring circuit initiates its light-measuring function after recovery thereof from an abnormal state caused by the noise and is capable of performing precise flash control While a preferred embodiment of the invention has been shown and described, it will be apparent to those skilled in the art that changes can be made in this embodiment without departing from the principles and spirit of the invention, the scope of which is defined in the appended claims.

I claim:

1. In flash tube apparatus comprising a drive circuit for ionizing gas in a flash tube by means of a trigger circuit, thereby causing flash discharge in said flash tube, and comprising a light-measuring circuit for measuring the light emitted by said flash tube and reflected by an object to be photographed and for controlling the light emitted by said flash tube, said light-measuring circuit being susceptible to erroneous operation caused by noise generated upon energizing of said trigger circuit, the improvement wherein said drive circuit includes delay means for delaying the flash emission from said flash tube until the lapse of a predetermined delay time commencing with the energizing of said trigger circuit, said delay time being longer than a period during which said light-measuring circuit may be adversely affected by noise generated upon the energizing of said trigger circuit.

2. Apparatus in accordance with claim 1, wherein said light-measuring circuit comprises an operational amplifier and a photosensitive element connected between the inverting and non-inverting input terminals of said operational amplifier.

3. Apparatus in accordance with claim 2, wherein the photosensitive element is a diode and a logarithmic diode is connected between output and input terminals of the amplifier and is bridged by an oppositely poled diode.

4. Apparatus in accordance with claim 1, wherein said delay means comprises a silicon controlled rectifier connected in series with said flash tube and a delay circuit connected to the gate of said silicon controlled rectifier, said delay circuit being adapted to supply a signal to the gate of said silicon controlled rectifier, thereby rendering the same conductive and thus inducing the flash emission from said flash tube, after the lapse of said predetermined delay time commencing with the energizing of said trigger circuit.

5. Apparatus in accordance with claim 4, wherein said delay circuit comprises a resistor in series with a capacitor and connected to said trigger circuit so that the capacitor starts charging through said resistor when the trigger circuit is energized.

6. Apparatus in accordance with claim 5, wherein said delay circuit further comprises a diac connecting the junction of said resistor and said capacitor to the gate of said silicon controlled rectifier.

* * * * *